US010737747B2

(12) United States Patent
Morilhat et al.

(10) Patent No.: US 10,737,747 B2
(45) Date of Patent: Aug. 11, 2020

(54) RETRACTABLE BOW LOADING SYSTEM AND METHOD

(71) Applicant: FMC Technologies, Sens (FR)

(72) Inventors: Eric Morilhat, Pont sur Vanne (FR); Valéry Duval, Maisons les Chaource (FR); Karim Yousfi, Paron (FR)

(73) Assignee: FMC Technologies, Sens (FR)

( * ) Notice: Subject to any disclaimer, the term of this patent is extended or adjusted under 35 U.S.C. 154(b) by 0 days.

(21) Appl. No.: 16/312,986

(22) PCT Filed: Jun. 22, 2016

(86) PCT No.: PCT/IB2016/001038

§ 371 (c)(1),
(2) Date: Dec. 21, 2018

(87) PCT Pub. No.: WO2017/221044

PCT Pub. Date: Dec. 28, 2017

(65) Prior Publication Data

US 2020/0180735 A1 Jun. 11, 2020

(51) Int. Cl.
*B63B 27/25* (2006.01)
*B63B 27/34* (2006.01)

(52) U.S. Cl.
CPC ..... *B63B 27/25* (2013.01); *B63B 27/34* (2013.01)

(58) Field of Classification Search
CPC ..... B63B 27/25; B63B 27/34
See application file for complete search history.

(56) References Cited

U.S. PATENT DOCUMENTS 8,568,076 B1 * 10/2013 Harris ..... B63B 27/34 114/242
2008/0289721 A1 11/2008 Park
(Continued)

FOREIGN PATENT DOCUMENTS

EP 2 382 124 B1 11/2011
EP 2 697 112 B1 2/2014
(Continued)

OTHER PUBLICATIONS

Four pages of still pictures taken from applicant's animation video entitled "FMC Technologies' Articulated Tandem Offshore Loader (ATOL)", which applicant uploaded to YouTube on Jun. 25, 2015.
(Continued)

*Primary Examiner* — Stephen P Avila

(57) ABSTRACT

Bow loading system to be installed on a forecastle deck of a first ship and comprising at least one fluid conveying pipe (118) having a valve coupler (112) at the first end of each pipe, which is intended to be connected to a complementary valve of a fluid conveying pipe of a support structure installed on a second ship; a fixed structure (120) to be fixed on the deck and forming an ascending ramp (122); a movable structure (140) movably mounted on the ramp (122) of the fixed structure and to which is linked each fluid conveying pipe (118) for moving the valve coupler (112) of each pipe from a retracted position to an extended position, in which the complementary valve can be connected to the valve coupler, and means (150) for moving the movable structure (140) from the retracted position to the extended position.

16 Claims, 6 Drawing Sheets

(56) References Cited

U.S. PATENT DOCUMENTS

| | | | | |
|---|---|---|---|---|
| 2009/0295150 | A1 | 12/2009 | Dupont et al. | |
| 2016/0362163 | A1* | 12/2016 | Lane | B67D 9/00 |

FOREIGN PATENT DOCUMENTS

| | | | |
|---|---|---|---|
| WO | WO 99/38762 | A1 | 8/1999 |
| WO | WO 2015/130701 | A1 | 9/2015 |

OTHER PUBLICATIONS

Google search results page showing the URL for applicant's animation video entitled "FMC Technologies' Articulated Tandem Offshore Loader (ATOL)", which applicant uploaded to YouTube on Jun. 25, 2015.

* cited by examiner

RETRACTABLE BOW LOADING SYSTEM AND METHOD

The invention relates to a ship bow loading system (BLS) and to an associated method.

It is intended to be used in a tandem offshore fluid transfer between two ships.

The fluid may be liquefied natural gas for example.

The first of the two ships, on which the bow loading system is permanently installed, may be a ship adapted to receive the gas for its transport, such as a tanker or a LNG-C (for "Liquefied Natural Gas Carrier"), for example a methane tanker.

The second of the two ships may be a production ship known by the name LNG-P (for "Liquefied Natural Gas Producer"), LNG-FPSO (for "Liquefied Natural Gas Floating Production Storage and Offloading"), or FLNG (for "Floating Liquid Natural Gas Unit"), a re-liquefaction ship (FSRU for "Floating Storage and Regasification Unit"), a GBS (for "Gravity Base Structure) or lastly a platform.

BACKGROUND OF THE INVENTION

A bow loading system generally comprises a single or multiple connecting valve couplers, installed at the bow of a ship, such as for example an LNG-C, to ensure connection of a single or multiple, rigid or flexible, offloading lines supported by a fixed or mobile structure installed on a second ship, such as an FLNG.

Such a system is known, for example, from European patent application EP2697112.

The bow loading system disclosed by this document is barely protected against green water loads and not more against corrosion.

SUMMARY OF THE INVENTION

The present invention generally relates to a provision making it possible to protect the bow loading system efficiently against green water loads and furthermore leading to other advantages.

To that end, the invention relates to a bow loading system to be installed on a forecastle deck of a first ship and comprising at least one fluid conveying pipe having a valve coupler at a first end of each pipe, which is intended to be connected to a complementary valve of a fluid conveying pipe of a support structure installed on a second ship; a fixed structure to be fixed on the deck and forming an ascending ramp; a movable structure movably mounted on the ramp of the fixed structure and to which is linked each fluid conveying pipe for moving the valve coupler of each pipe from a retracted position to an extended position, in which the complementary valve can be connected to the valve coupler; and means for moving the movable structure from the retracted position to the extended position.

Such provisions make it possible to install the bow loading system on a deck of a ship of the type comprising an extension of a forecastle deck extending from one side to the other of the ship and above the deck, so as to be completely or virtually completely protected by it against green water loads in its retracted position. Occasionally, it can be moved to the extended position to perform the offloading operations. Thanks to these provisions, the bow loading system is also protected against a potential collision.

More particularly, in case of an emergency disconnection, a quick retraction of the bow loading system, from the offloading position to the retracted position is possible, ensuring no risk of collision with supporting structure of the offloading system or other equipment. Indeed, the ramp enables simultaneous downward and backward movements.

According to advantageous provisions of the invention, which may be combined:

- The ramp has a rectilinear or curved shape to define, respectively, a rectilinear or a curved trajectory for the movable structure.
- The valve coupler of each fluid conveying pipe is oriented downwardly for connecting the associated valve thereto from underneath.
- Each fluid conveying pipe is constituted by at least one flexible section
- Each fluid conveying pipe is constituted by a plurality of rigid sections linked to each other by fluid tight articulations.
- The movable structure forms a carriage rolling on the fixed structure.
- The carriage comprises wheels for rolling on rails of the fixed structure forming the ramp.
- The bow loading system is adapted to move its movable structure to its retracted position in a procedure for emergency disconnection at a speed higher than the speed of normal retraction after a fluid transfer operation.
- The means for moving the movable structure are adapted for moving the movable structure to its retracted position in the procedure for emergency disconnection at a speed higher than the speed of normal retraction after a fluid transfer operation.
- The movable structure is adapted to be moved to its retracted position in the procedure for emergency disconnection at a speed higher than the speed of normal retraction after a fluid transfer operation, by using gravity.
- The means for moving the movable structure comprise hydraulic, electric or pneumatic actuators.
- The movable structure comprises at least one intermediate platform for reacting to the equipment of the bow loading system.
- The fixed structure comprises stairs running alongside the movable structure, on at least one side thereof, for getting to the movable structure.

The invention also relates to a ship comprising a bow loading system as defined above.

According to an embodiment, the bow loading system is mounted on a forecastle deck of the ship and an extension of a forecastle deck hull extends above the deck, from one rear end of the bow loading system on one side of the ship to the other rear end of the bow loading system on the opposite side of the ship, and at least up to the upper limit of the bow loading system in its retracted position, on at least a part of the length of the extension.

The invention also relates to a method for fluid transfer with a bow loading system as defined above or a ship wherein, in a procedure for emergency disconnection, the movable structure is moved to its retracted position at a speed higher than the speed of normal retraction after a fluid transfer operation.

Other features and advantages of the invention will appear in the light of the following description, which is non-limiting and made with reference to the accompanying schematic drawings (at different scales).

DETAILED DESCRIPTION OF THE INVENTION

Figure 1:
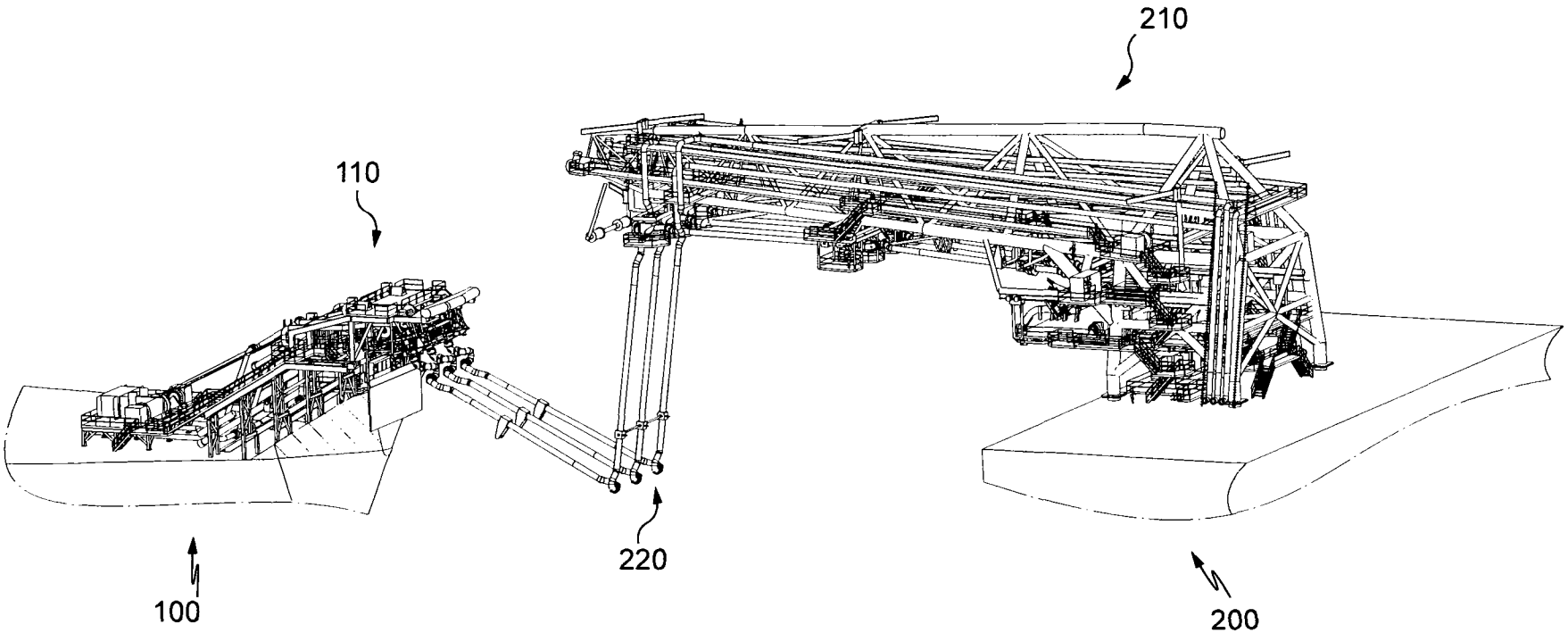
FIGS. 1 and 2 present different successive steps (perspective view and side view, respectively) of the connection of the piping of two ships (a LNGC and a FLNG) illustrated partially and using the bow loading system according to the invention.
Figure 2:
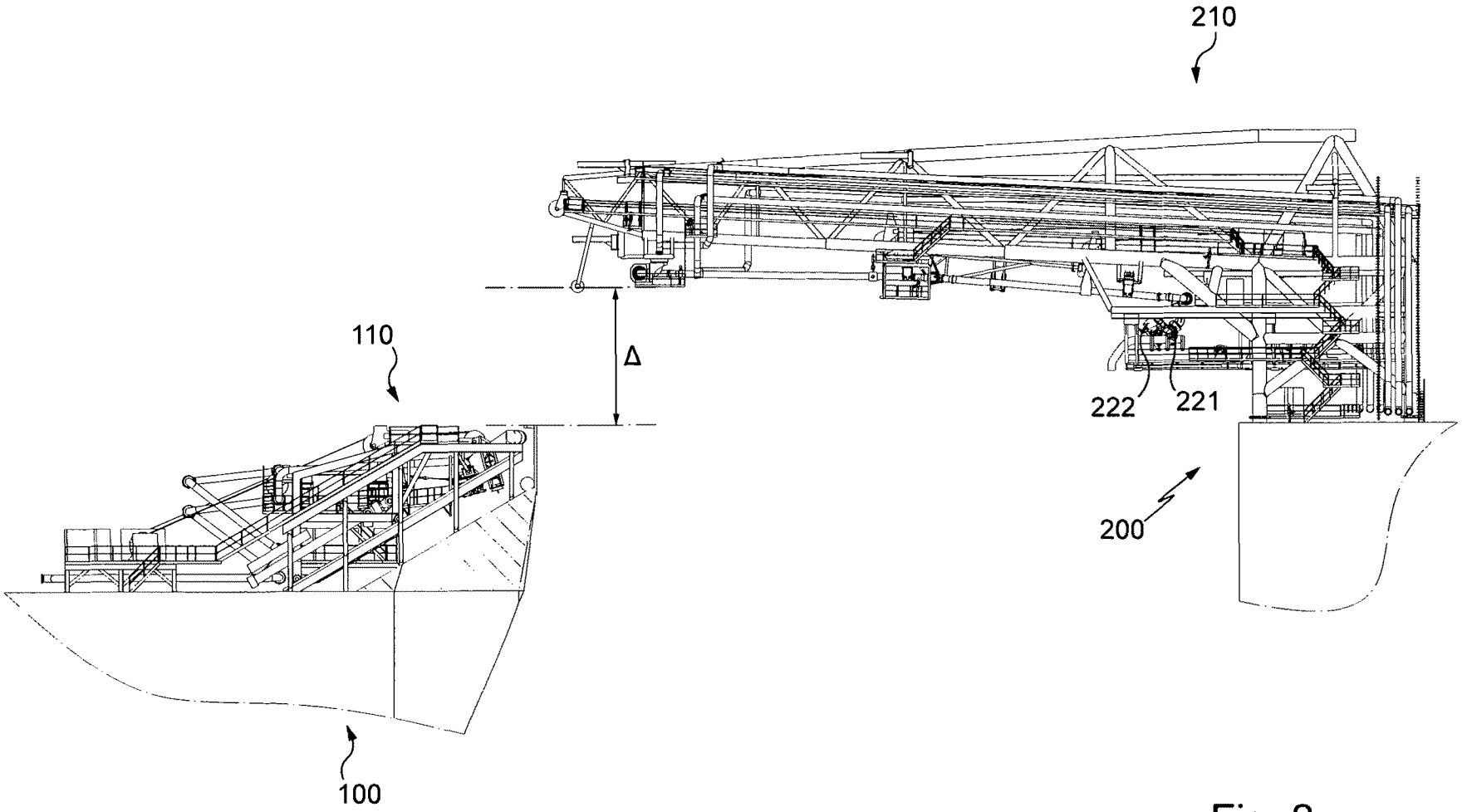

In FIGS. 1 and 2, a LNGC 100 has been represented close to a FLNG 200. A gantry 210 is fastened to the FLNG 200.

Three articulated tubes 220 are suspended to the gantry 210.

Each articulated tube 220 constitutes a movable pipe for conveying fluid from the FLNG 200 to the LNGC 100 and comprises an outer valve 221.

The articulated tubes 220 are joined to each other by a transverse holding structure (not visible on the drawings). Two male centering cones are fastened upwardly on that transverse holding structure (the cones having the same orientation, only one is visible on FIG. 2 with reference 222).

Figure 3:
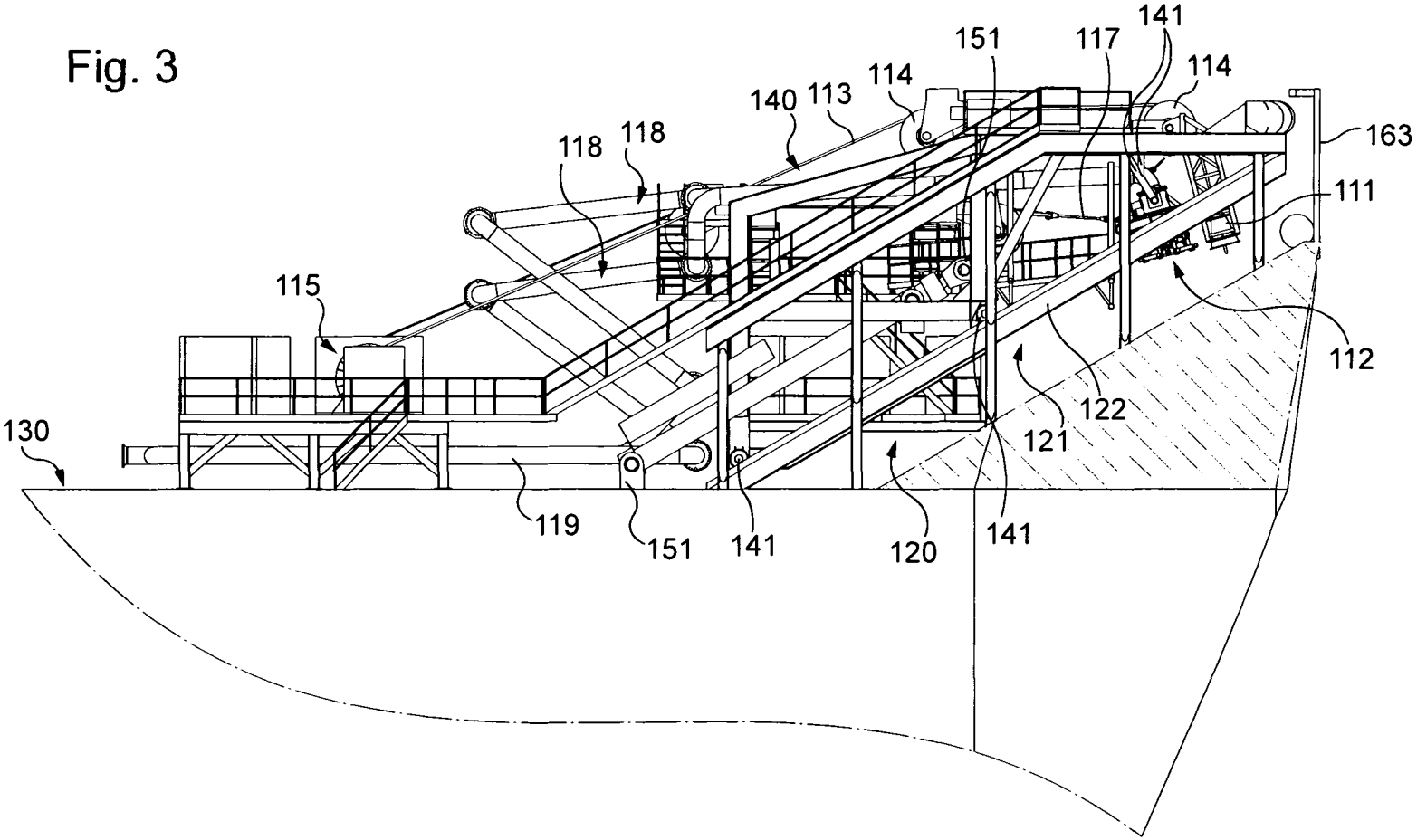
FIGS. 3 and 4 are side views presenting the LNGC of FIGS. 1 and 2 in the two positions of the bow loading system according to the invention (retracted and extended).
Figure 4:
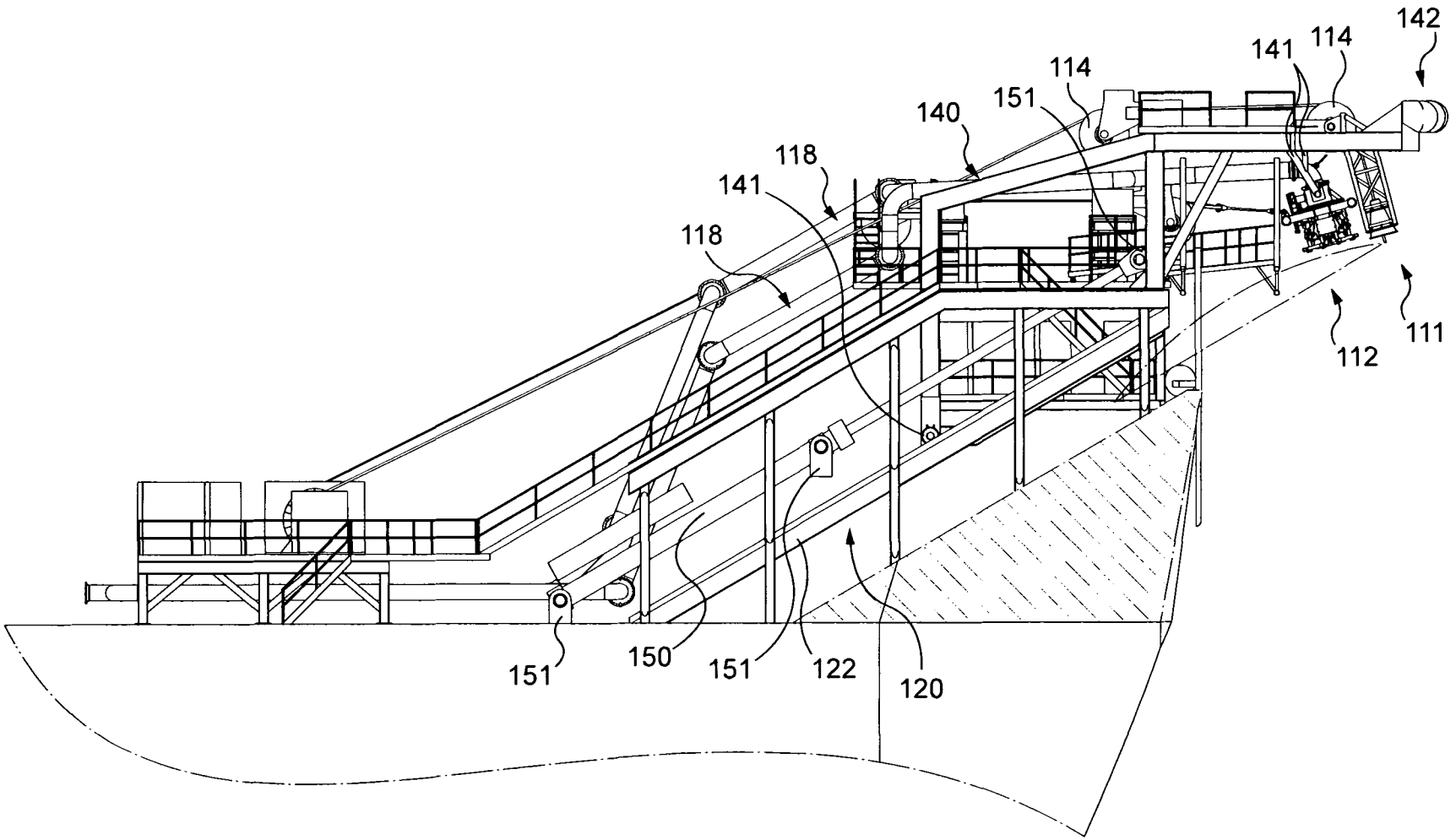

Two female centering cones are fastened downwardly on a support structure 110 mounted on the forecastle deck of the LNGC 100 (those cones having also the same orientation, only one is visible with reference 111; see in particular FIGS. 3 and 4).

The male centering cones 222 are, in the configuration represented, intended to be engaged in the female centering cones 111, 30 respectively (see FIG. 1).

Each downwardly oriented female centering cone 111 has its opening centered on an axis forming an angle with the vertical. In the vicinity of that cone 111 there is a valve coupler 112, oriented parallel to the cone 111.

A third valve coupler is arranged between the two others for connecting in total each outer valve 221 to a valve coupler 112.

Here also only one valve coupler 112 is visible (see in particular FIGS. 3 and 4).

A cable 113 (see in particular FIG. 5) controlled via pulleys 114, by winches 115, passes through each female centering cone 111 to meet the transverse holding structure to which it is adapted to be connected by a locking system.

These cables are used for connecting the outer valves 221 of the articulated tubes 220 to the valve couplers 112 from underneath by pulling up the outer valves 221 towards the valve couplers 112.

A winch 116 controlling a safety cable 117 passing on a pulley 116' can also be seen. The safety cable 117 is constantly attached to the lower part of one of the three valve-couplers of the LNGC 100 (the central one).

More precisely, each valve coupler 112 is constituted by a lower valve and an upper valve (not visible on the figures). Each valve-coupler 112 is furthermore provided with an emergency release system (ERS for Emergency Release System or PERC for Powered Emergency Release Coupler), by which the lower valve is detached from the upper valve in case of emergency disconnection, while remaining connected to the outer valve 221 of the hinged line. The winch 116 then constitutes a brake for the unwinding of the safety cable 117, which slows the drop of the free ends of the articulated tubes 220.

Those features are known from European patent application EP2382124. They will therefore not be described in further details here. In particular, the other cables used for maneuvering the articulated tubes 220 as well as the corresponding connection, disconnection and emergency disconnection procedures are not described here but are implemented in the same way as those described in this patent application.

Alternatively, if a pointed segment is used on the gantry 210 as in the case of the structure described in the above-mentioned patent application EP2697112, the cables and the procedures implemented here are those as described in this European patent application EP2697112.

According to the invention, the bow loading system 110 comprises two main parts, namely, on the one hand, a fixed structure 120 fixed on the deck 130 of the LNGC 100 and forming an ascending ramp 121 and, on the other hand, a movable structure 140 movably mounted on the ramp 121 of the fixed structure 120 from a retracted position (or stored position) shown on FIG. 3 to an extended position shown on FIG. 4.

The aim of this movement from the retracted position to the extended position is to bring the valve couplers 112 into a position for a connection to the outer valves 221 of the articulated tubes 220.

For this purpose, each valve coupler 112 is mounted at the first end of a respective one of three fluid conveying pipes 118, and each of these fluid conveying pipes is linked to the movable structure 140 so as to be able to transfer the movement of the movable structure 140 to the valve couplers.

The link is here performed by means of fixing lugs 141 (see FIGS. 3 and 4) linked both to metallic beams forming the movable structure 140 and each valve coupler 112. In other embodiments, the fluid conveying pipe can be linked to the movable structure via one the rigid sections forming it and which are linked to each other by fluid tight articulations, in a manner similar to the sections of the articulated tubes 220.

Other fixing methods can of course be implemented, such as for example the use of collars for fixing the valve couplers to the beams of the movable structure, in particular when tubular beams are used.

Thanks to the fluid tight articulations, each fluid conveying pipe forms a broken line which can extend from a folded position to an extended one.

At their end opposite to the end bearing the valve couplers 112, each fluid conveying pipe 118 is linked, via a fluid tight articulation, to another pipe 119 mounted on the deck 130 of the LNGC, to transfer the fluid coming from the FLNG to tanks of the LNGC.

The movable structure 140, made of an assembly of metallic beams welded to each other, forms here a carriage rolling on the fixed structure 120. It comprises, for this purpose, wheels for rolling on rails 122 of the fixed structure 120. Those rails 122 are welded to the fixed structure 120, which is also constituted by an assembly of metallic beams welded to each other.

In practice, the carriage is received between two lateral parts of the fixed structure 120. Each of these lateral parts comprises one rail 122 which, with the other one of the second part, forms the ramp 121.

In the present embodiment, the ramp has a rectilinear shape to define a rectilinear trajectory for the movable structure. This trajectory is visible in dashes on FIG. 4.

As can also be seen on this figure, the ramp can, as a variant, have a curved shape to define a curved trajectory for the movable structure.

For moving the movable structure 140 from the retracted position to the extended position as well as from the latter position to the retracted position, the bow loading system 110 also comprises means for moving this movable structure 140.

The moving means comprise for this purpose, in the present embodiment, two hydraulic jacks 150 fixed, each, by means of forks 151, to the fixed structure 120, the deck 130 of the LNGC 100 and to the movable structure (see in particular FIGS. 3 and 4).

Those jacks 150 are also adapted, here, for moving the movable structure 140 to its retracted position in a procedure for emergency disconnection, at a speed higher than the speed of normal retraction, after a fluid offloading operation.

Hence, in practice, the jacks of the present invention are double effect jacks. As a variant, single effect jacks can be used and retraction of the movable structure 140 to its retracted position in a procedure for emergency disconnection can then be obtained at a speed higher than the speed of normal retraction after a fluid offloading operation, by merely using the gravity. In another embodiment, gravity can also be used with a double effect jack.

As can also be seen on some of the drawings, the front part of the movable structure 140 is also equipped with a bumper 142 of rubber shock absorbers to protect the female centering cones 111 and the valve couplers 112.

Figure 5:
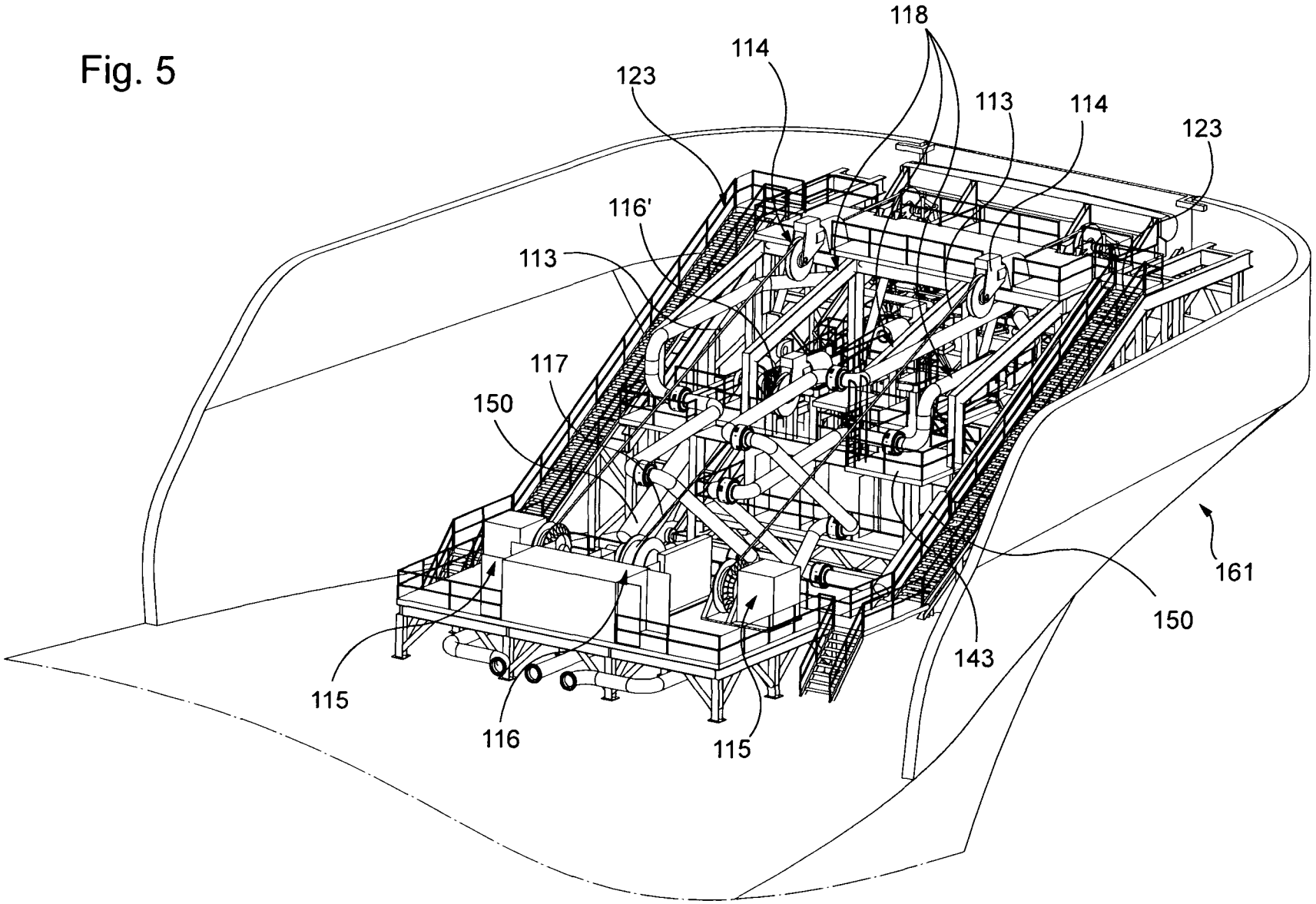
FIGS. 5 and 6 present two perspective views of the forecastle part of the ship having the bow loading system according to the invention.
Figure 6:
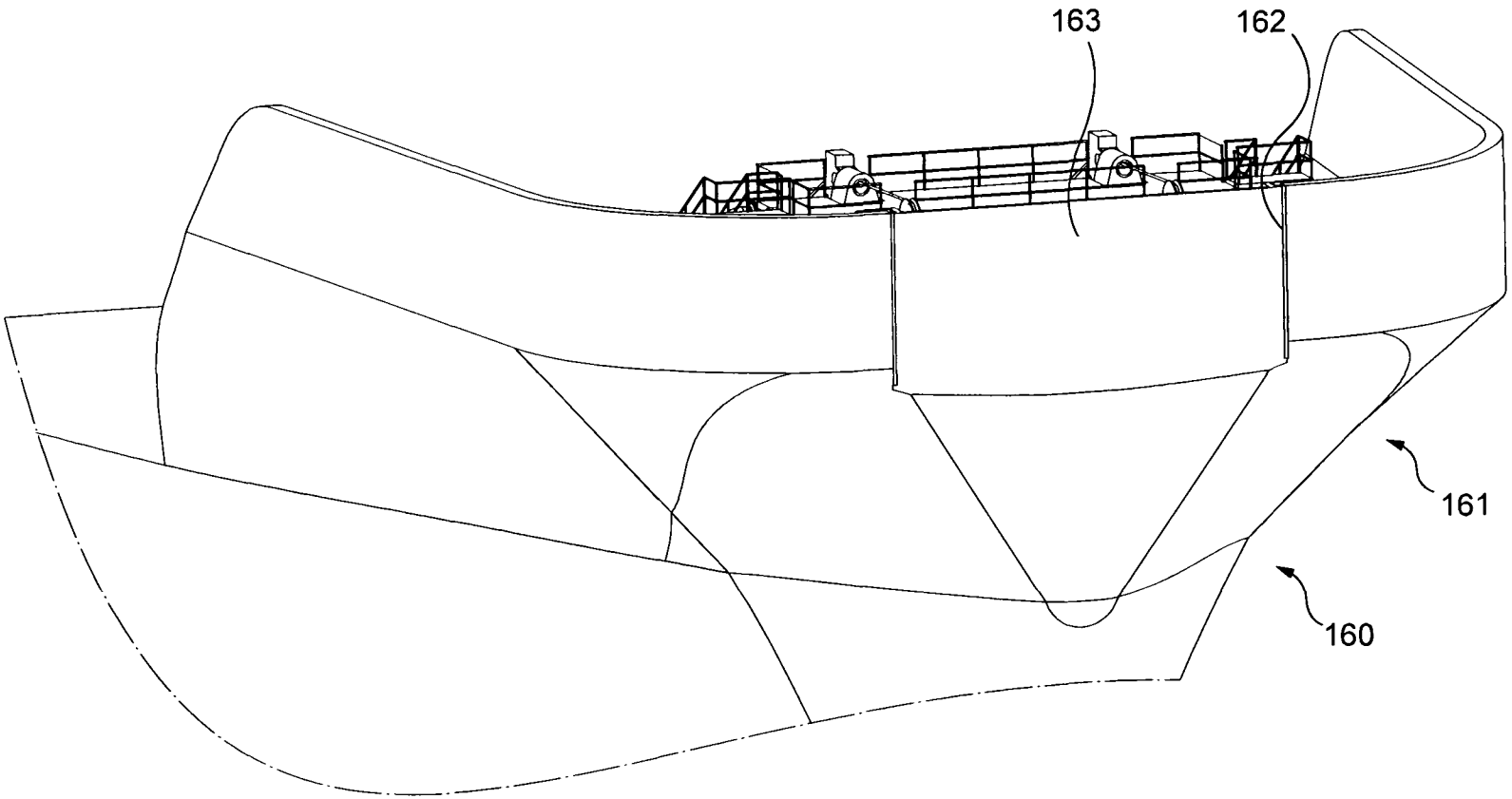

As appears more particularly from FIGS. 5 and 6, thanks to the invention, the bow loading system 110 in its retracted position, during transit or reached after an emergency sequence, can be fully protected by an extension 161 of the LNGC forecastle deck hull 160, so as to guarantee a better protection of the equipment on it against green water loads and resulting corrosion, as well as potential collisions. It is also to be noted that this extension 161 is completely visible on FIGS. 5 and 6 and only partially illustrated on FIGS. 1 to 4.

In practice, the extension 161 of the forecastle deck hull 160 extends above the deck 130 from a rear end of the bow loading system 110 on one side of the ship (i.e. an end of the bow loading system 110 opposite to the end provided with the valve couplers 112) to the other rear end of the bow loading system 110 on the opposite side of the ship. This extension also extends over the upper limit of the bow loading system 110 in its retracted position, over at least a part of the length of this extension 161. In the present embodiment, the bow loading system is situated under the top limit of the extension 161 on the sides of the ship but extends slightly above the top limit of the extension 161 at the prow of the ship, by reason of a cut out 162 made in the extension 161 of the hull and in which a closing panel 163 is, here, slidably mounted. Hence, in practice, the bow loading system is also situated below the top limit of the extension at the prow of the ship when the panel is in its closed position, where it covers the cut out 162. This cut out 162 is made in the present invention to permit the passage of the movable structure 140 of the bow loading system at the beginning of its movement from the retracted position to the extended position. It extends over about $1/5^{th}$ of the height of the extension and virtually the whole width of the prow.

Depending on the arrangement of the bow loading system, one can dispense from the cut out in other embodiments.

It shall also be noted that in the extended position, the bow loading system 110 of the present embodiment is situated above the extension 161 of the forecastle deck hull and beyond it towards the FLNG. Moreover, the extension 161 has only been partially shown on FIGS. 1, 2, 3 and 4 to highlight the other features of the bow loading system 110.

As can also be seen on FIG. 5, the movable structure comprises also an intermediate platform 143 for getting to the equipment of the bow loading system 110, which platform is located at the level of the top limit of the extension 161 of the deck hull 160 in the extended position of the bow loading system 110.

Thanks to the movable structure 140, the access to the equipment of the bow loading system 110 is possible via this platform 143 but also from the deck of the LNGC.

For getting to the intermediate platform 143 as well as other parts of the movable structure 140, the fixed structure comprises, as also shown on FIG. 5, stairs 123 which run alongside both sides of the movable structure 140.

The functioning of the bow loading system according to the invention is the following:

During the transit and the approach phase towards the FLNG, the bow loading system 110 is in retracted position (FIG. 3). In this position, the complete bow loading system is fully protected by the fixed green water protection (extension 161). As soon as the LNGC is correctly located and oriented regarding the FLNG, stabilized close to the theoretical set point, the bow loading system is extended and locked in full extended position (FIG. 4). Then the connection of the offloading lines 220 to the connecting valve couplers 112 on the bow loading system and the offloading can be performed (FIG. 1).

In case of an emergency disconnection procedure, the offloading lines are disconnected, the bow loading system retraction is initiated and performed quick enough to ensure significant clearance with the offloading lines supporting structure (gantry 210) installed on the FLNG, when the LNGC is under.

Thanks to the invention:

1. The bow loading system can be moved from a stored position to an offloading position along a trajectory which can be linear or curvilinear.
2. A quick retraction of the bow loading system from the offloading position to the stored position is managed in case of emergency disconnection, ensuring no risk of collision with supporting structure of the offloading system or other equipment. It can be active using the bow loading system maneuvering actuators or passive using gravity.

The retractable bow loading system ensures, in full retracted position, a significant clearance (see "Δ" on FIG. 2) with the fixed or mobile structure on the FLNG, which supports, the single or multiple, rigid or flexible, offloading lines:

- In the approach phase, before any connection, the bow loading system is in full retracted position, protected by the green water protection (the above-mentioned extension);
- During offloading, in case of emergency disconnection required due to abnormal conditions, a quick retraction of the bow loading system is performed, which guarantees that the bow loading system is promptly in full retracted position, protected by the green water protection.

3. In retracted (stored) position, all the equipment of the bow loading system are accessible from the LNGC deck, which enables easier and safer maintenance operations.

Access to any equipment on the bow loading system is feasible, from LNGC deck, to perform any maintenance operation when the bow loading system is in full retracted position. Moreover, maintenance operation can be done during LNGC transit phases in safe condition for the operators: above the LNGC deck and protected by green water protection.

4. The bow loading system in retracted position, during transit or reached after an emergency sequence, is fully protected by the LNGC forecastle deck hull (extension) and under its top limit, which guarantees a better protection of the equipment on it against corrosion, green water loads and potential collision.

5. The height of the bow loading system in full retracted position is much more lower than in the fully extended position to perform offloading operations, which allows a better visibility during LNGC transit.

The invention is not limited to these embodiments and covers all the variants within the capability of the person skilled in the art, within the scope of the claims.

In particular, the first and the second units can be slidably linked together by rails having complementary shapes, or holded together by wheels interposed between guiding surfaces of U-shaped rails.

Moreover, each fluid conveying pipe constituted by the plurality of rigid sections linked to each other by fluid tight articulations can be replaced by a fluid conveying pipe constituted by at least one flexible section.

In addition, the means for moving the movable structure can be constituted by electric or pneumatic actuators instead of hydraulic ones.

The invention claimed is:

1. A bow loading system to be installed on a forecastle deck of a first ship and comprising:

at least one fluid conveying pipe having a valve coupler at a first end of the pipe, the valve coupler being configured to be connected to a complementary valve of a fluid conveying pipe of a support structure installed on a second ship;

a fixed structure which is configured to be fixed on the deck, the fixed structure comprising an ascending ramp;

a movable structure which is movably mounted on the ramp of the fixed structure and to which is linked each fluid conveying pipe for moving the valve coupler of each pipe from a retracted position to an extended position in which the complementary valve can be connected to the valve coupler; and means for moving the movable structure from the retracted position to the extended position.

2. The bow loading system according to claim 1, wherein the bow loading system is adapted to move the movable structure from its extended position to its retracted position in a procedure for emergency disconnection at a speed higher than a speed of normal retraction after a fluid transfer operation.

3. The bow loading system according to claim 2, wherein the means for moving the movable structure is adapted for moving the movable structure from its extended position to its retracted position in the procedure for emergency disconnection at a speed higher than the speed of normal retraction after a fluid transfer operation.

4. The bow loading system according to claim 2, wherein the movable structure is adapted to be moved from its extended position to its retracted position in the procedure for emergency disconnection at a speed higher than the speed of normal retraction after a fluid transfer operation by using gravity.

5. The bow loading system according to claim 1, wherein the means for moving the movable structure comprise hydraulic, electric or pneumatic actuators.

6. The bow loading system according to claim 1, wherein the ramp has a rectilinear or curved shape to define, respectively, a rectilinear or a curved trajectory for the movable structure.

7. The bow loading system according to claim 1, wherein the movable structure forms comprises a carriage which is configured for rolling on the fixed structure.

8. The bow loading system according to claim 7, wherein the ramp comprises rails and the carriage comprises wheels for rolling on the rails.

9. The bow loading system according to claim 1, wherein the valve coupler of each fluid conveying pipe is oriented downwardly to enable its complementary valve to be connected thereto from underneath.

10. The bow loading system according to claim 1, wherein each fluid conveying pipe comprises a plurality of rigid sections linked to each other by fluid tight articulations.

11. The bow loading system according to claim 10, wherein each fluid conveying pipe comprises at least one flexible section.

12. The bow loading system according to claim 1, wherein the movable structure comprises at least one intermediate platform for reacting for providing access to equipment of the bow loading system.

13. The bow loading system according to claim 1, wherein the fixed structure comprises stairs running alongside at least one side of the movable structure for providing access to the movable structure.

14. A ship comprising a bow loading system as defined in claim 1.

15. The ship according to claim 14, wherein the bow loading system is mounted on a forecastle deck of the ship, and wherein an extension of a forecastle deck hull extends above the deck from one rear end of the bow loading system on one side of the ship to the other rear end of the bow loading system on the opposite side of the ship and at least up to an upper limit of the bow loading system in its retracting position along at least a part of the length of the extension.

16. A method for fluid transfer with a bow loading system according to claim 1, wherein, in a procedure for emergency disconnection, the movable structure is moved to its retracted position at a speed higher than a speed of normal retraction after a fluid transfer operation.

* * * * *